US005901404A

United States Patent [19]

Lin

[11] Patent Number: 5,901,404

[45] Date of Patent: May 11, 1999

[54] BRUSH AND CONTAINER ASSEMBLY

[76] Inventor: Chung Sing Lin, No. 33-1, Ta Chiao 3rd Street, Yung Kang Shih, Tainan Hsien, Taiwan

[21] Appl. No.: 08/887,118

[22] Filed: Jul. 2, 1997

[51] Int. Cl.[6] ..... A46B 7/04; A46B 9/08

[52] U.S. Cl. ..... 15/184; 15/104.94; 221/228; 221/232

[58] Field of Search ..... 15/104.94, 176.1, 15/176.6, 184; 132/308, 310, 311; 206/362.1; 221/226, 228, 229, 232

[56] References Cited

U.S. PATENT DOCUMENTS

| | | | |
|---|---|---|---|
| 1,573,648 | 2/1926 | Sheely | 15/184 |
| 2,159,914 | 5/1939 | Tweedale | 15/176.6 |
| 2,848,002 | 8/1958 | Hirschfeldt | 132/310 |
| 4,101,053 | 7/1978 | Mast | 221/232 |
| 4,346,495 | 8/1982 | Lin | 15/184 |
| 4,892,732 | 1/1990 | Shackelford | 132/310 |
| 5,048,720 | 9/1991 | Hoke | 221/229 |
| 5,144,712 | 9/1992 | Hansel | 15/184 |
| 5,504,962 | 4/1996 | Byun | 15/184 |
| 5,598,599 | 2/1997 | Haiduk | 15/176.1 |

*Primary Examiner*—Terrence H. Till
*Attorney, Agent, or Firm*—Bacon & Thomas, PLLC

[57] ABSTRACT

Brushes held in a container includes a plurality of brushes, and a container storing the brushes in its interior. A spring for pushing up brushes to let one of them positioned in an upper end of the interior half pushed out of an outlet. Each brush has bristles is sealed in a housing, with their roots clamped firmly in a rear portion of the housing, which has a thin neck between a front portion and the rear portion. The neck is easily broken, letting the front portion removed to let the bristles expose out for use, with the container able to serve as a grip. After an uppermost brush in the container is used, the next one is pushed out of an outlet of the container to be used.

7 Claims, 3 Drawing Sheets

BRUSH AND CONTAINER ASSEMBLY

BACKGROUND OF THE INVENTION

This invention relates to brushes held in a container, particularly to brushes stored in a container and dispensed out one by one from the container for use or held in said container one by one with the container serving as a grip to handle the brushes.

Common traditional brushes generally have a grip combined with bristles planted in a front portion of the grip as integral, whether they are small or large. And they are used in painting, coating or cleaning dirt,, not needing hygienic condition.

If brushes are used in cosmetic make up or in applying medicinal lotions or cleaning wounds, they must be very hygienic or even without bacteria, and then such brushes mentioned above cannot satisfy the need. Then bristles have to be wrapped up to separate the bristles from open air. However, this kind of wrapping does not guarantee bristles completely hygienic or clean, not improving their practical effect.

SUMMARY OF THE INVENTION

The purpose of the invention is to offer brushes held in a container, with each brush protected sealingly with a housing before use to keep it clean and hygienic. The container can store a plurality of brushes with two half housings combined together in its interior, and then brushes are dispensed one by one out of an outlet in an upper end for use, with the container able to serve as a grip of the brushes.

A feature of the invention is a housing surrounding sealingly each brush and having an annular thin neck in an intermediate portion to be broken to let a front portion of the housing he separated from a rear portion so as to let bristles half expose out for use. And the rear portion of the housing has two large opposite sides formed corrugated to clamp roots of the bristles firmly, and a gap is formed between the roots of the bristles and inner surfaces of the two sides of the rear portion of the housing.

Another feature of the invention is the container having an interior for storing a plurality of brushes placed one on one in a horizontal condition, and a spring is placed under the brushes to push them upward, letting an uppermost brush pushed forward out of a front outlet in the upper end of the container or to let the front half of the uppermost brush protrude out of the front outlet of the container with the front half housing removed to let bristles expose for use, with the container functioning as a grip of the brush.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
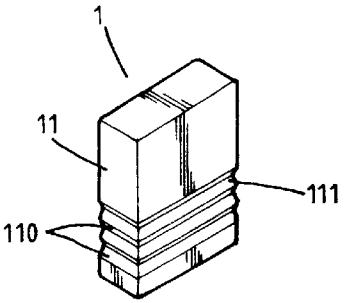
FIG. 1 is a perspective view of a brush to be held in a container in the present invention.
Figure 2:
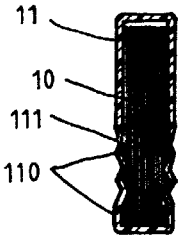
FIG. 2 is a cross-sectional view of the brush to be held in a container in the present invention.
Figure 3:
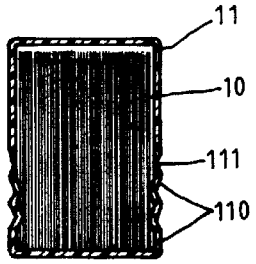
FIG. 3 is another cross-sectional view of a brush held in a container in the present invention.

A preferred embodiment of one of brushes held in a container in the present invention, as shown in FIGS. 1–3, includes bristles 10 and a housing 11, in which the bristles of a bristle assembly 10 are surrounded sealingly and roots of the bristles are fixed firmly. The housing 11 is formed with a rear portion 110 corrugated to clamp the root portion of the bristle assembly securely, and a thin frangible or easily-breakable neck 111 at an upper (or front) end of the rear portion to permit an upper (,or front) portion of the housing 11 to be removed from the rear portion by breaking the neck 111. Then the upper portion of bristles 10 will be exposed out for use.

Figure 4:
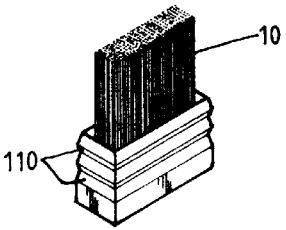
FIG. 4 is a perspective view of bristles of the brush half exposed out with an upper (or front) portion of a housing removed in the present invention.
Figure 5:
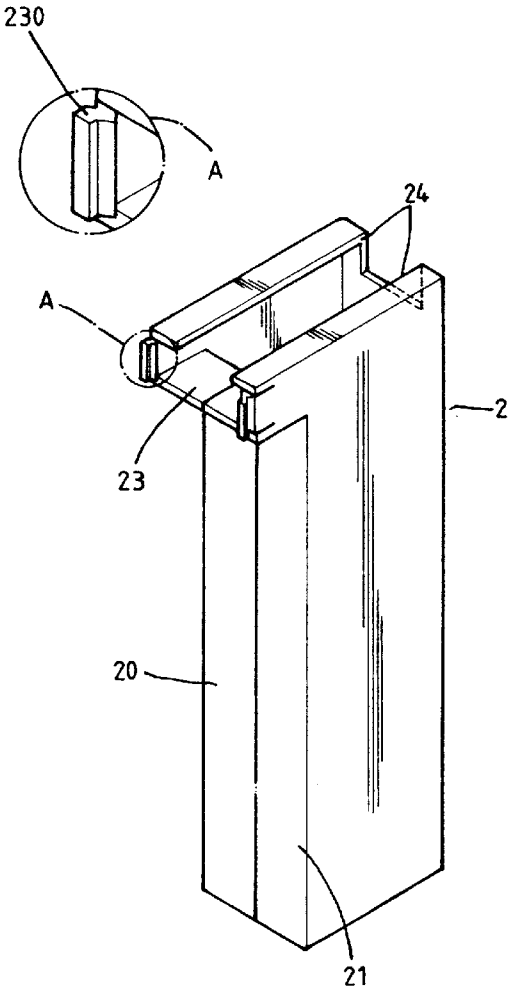
FIG. 5 is a perspective view of a container for holding the brushes in the present invention.
Figure 7:
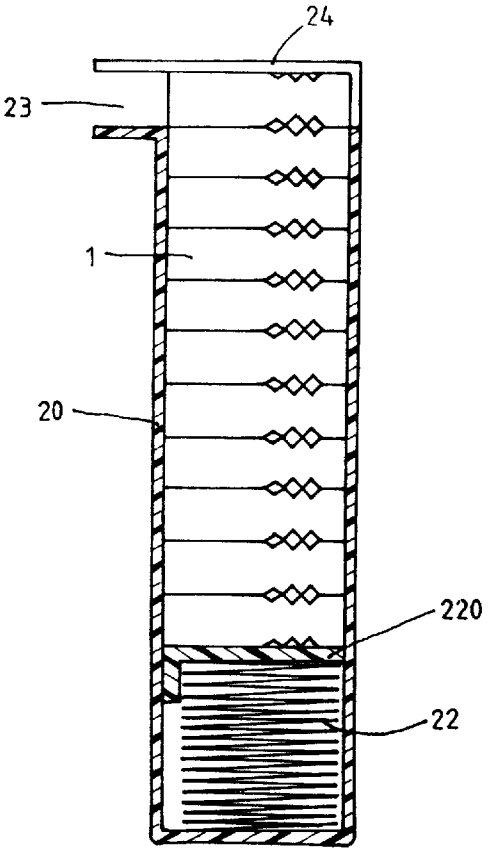
FIG. 7 is a cross-sectional view of brushes held in a container in the present invention.

In the structure of the present invention, the bristles 10 of each brush 1 are surrounded sealingly in the housing 11 before they are used. Thus, bristles 10 are kept clean, even able to be kept in no-bacteria condition before use. In case of need, the bristles 10 can be immersed or soaked in a liquid (for cleaning or hygienic purpose). Then the liquid can never evaporate before brushes are used by breaking the neck 111 to let the upper (or front) portion of each housing 11 removed to expose the bristles 10, as shown in FIG. 4. Further, the lower (or rear) corrugated portion of each housing 11 serves as a grip for a user to hold it, obtaining effect of keeping clean the bristles 10 before use. In addition, between the outer periphery of the bristles 10 and inner surfaces of the two opposite walls of the corrugated lower portion of the housing 11 of the housing 11 exists a gap, as shown in FIGS. 2 and 3. Then if the bristles 10 are immersed in a liquid before removing the upper portion of the housing 11, the liquid will remain in the gap, without sticking on the upper portion when it is removed.

The container 2 consists of two housing halves, a first one 20 and a second half 21, defining an interior for storing a plurality of brushes 1 placed one on one horizontally therein. Further, a plate 220 is disposed under the brushes 1 and a spring 22 is placed under the plate 220 on a bottom wall of the interior so that the brushes 1 may be elastically pushed up one by one by the spring 22.

The first and the second half housings 20 and 21 after combined together have an outlet 23 formed in an upper end,, and an elastic clamp 230 located at two sides of the outlet 23 in corresponding to the neck 111 of each brush 1, and an opening 24 extending from the front to the rear formed in the upper end of the two half housings 120, 21, permitting an uppermost brush at top of the interior of the container 2 moved manually by a user from behind to forward until the neck 111 of the brush 1 is clamped by the elastic clamps 230, 230, stopped in that position and half projecting out of the container 2.

Figure 6:
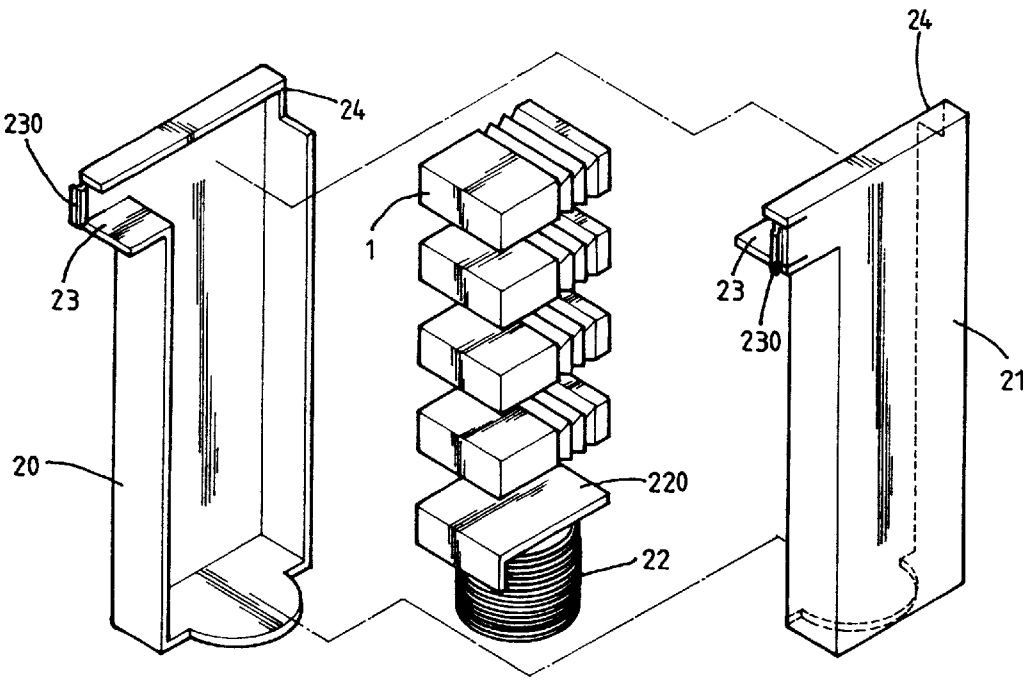
FIG. 6 is an exploded perspective view of the container holding brushes in the present invention.

Further, as shown in FIG. 6, the first half housing 20 has a bottom wall larger than that of the second half housing 21, and then in producing process the brushes 1 and the spring 22 are at first placed in order in the half housing 20 on the large bottoms and then the second half housing 21 may be assembled with the first half housing 20 in a convenient way.

The size of the brushes 1 and the container 2 for storing the brushes are not limited, and there may different-sized containers for different-sized brushes. For example, if the brushes 1 are rather large, a user can directly grip the brushes 1 on the corrugated rear portion of the housing 11. Then the container 2 can store a plurality of the brushes 1 therein, and each brush can be pushed out of the outlet 23 and then the neck 111 is broken to remove the front portion of the housing 11 for the bristles 10 to expose out for use.

In case the brushes 1 are very small for a user to grip the corrugated portion 110 of the housing 11, the methods shown in FIGS. 8–12 can be used.

1. At first, a finger is extended in the opening 24 to touch and push the uppermost brush 1 to the outlet 23 fin the arrow-head direction shown in FIG. 9 until the neck 111 are clamped by the elastic clamps 230, 230, with the corrugated portion 110 located in the outlet 23 in a stopped condition. In pulling the brush 1 the corrugated portion 110 and the neck 111 may be useful for fingers to push forward the brush 1.

Figure 11:
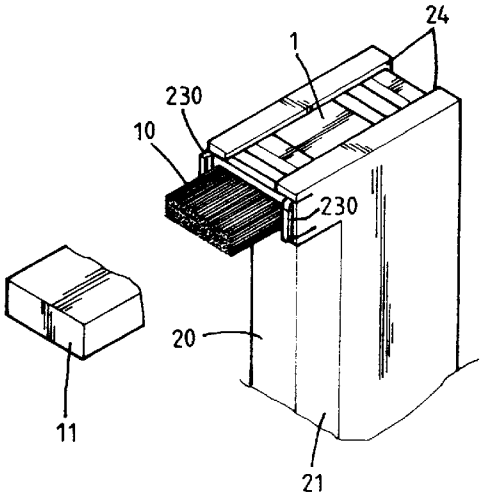
FIG. 11 is a perspective view of the uppermost brush projecting out of the container with the the front half of the housing removed for a half of the bristles to expose for use, with the container functioning as a grip in the present invention; and, FIG. 12 is a perspective view of one brush taken out of the container in the present invention.
Figure 8:
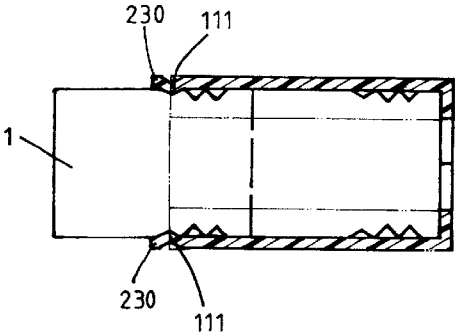
FIG. 8 is an upper view of one of brushes held is in a container half exposed out of the container in the present invention.
Figure 9:
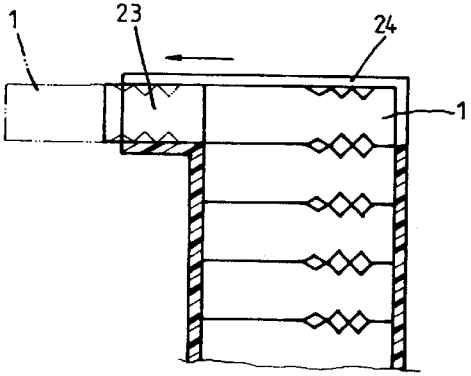
FIG. 9 is a side cross-sectional view of an uppermost one of the brushes held in the container pushed half projecting out of an outlet of the container in the present invention.

2. Next, if the brush 1 is wanted to be used, the upper (or front) portion of the housing 11 is to be pulled up and down as shown by the arrow-head in FIG. 10, ripping and removing the front portion from the neck 111 as shown in FIG. 11. Consequently, the bristles 10 will appear, but the brush 1 still remains half in the container 2 and half projecting out thereof.

3. Then the container 2 is gripped with a hand, the bristles 10 can be used, for example, in coating finger nail pigment (contained in the bristle), shoe cream (contained in the bristles) or detergent (contained in the bristles) or dusting (with nothing on the bristles), etc.

As seen from the aforesaid description, fit is a special feature of the invention that each brush 1 is kept clean in a sealed condition before it is to be used, and if a liquid is contained in the bristles, it cannot be dispersed around after the front portion of the housing is removed off. Further, the container 2 in the invention has not been seen in the prior art, able to store a plurality of brushes, which are then dispensed out one by one for use.

Figure 12:
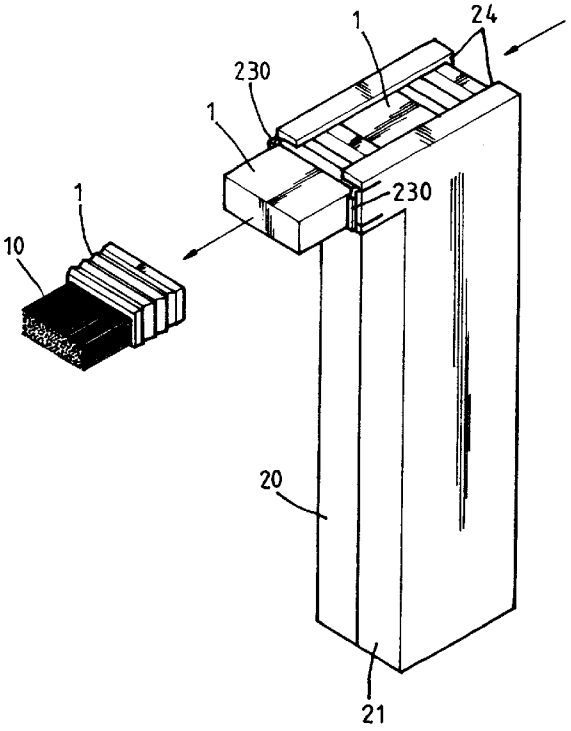
Figure 10:
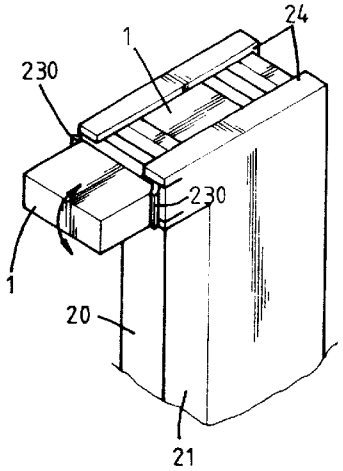
FIG. 10 is a perspective view of the uppermost brush half projecting out of the container, with a front half of the housing removed from a rear half in the present invention.

Particularly, if the brush 1 is comparatively small, the container 2 can be utilized as a grip of the brush 1, with one of the brushes 1 is positioned at the outlet 23, and with the front portion of the housing 11 removed off. After the uppermost one of the brushes 1 becomes useless, it can be taken out of the container 2 by pushing the next one located behind the uppermost one, which is then pushed out of the outlet 23 to fall down from the container 2, as shown in FIG. 12. Thus, the next brush 1 can be used.

In order to prove advantages of the brushes 1 in the present invention, some experiments made are described below.

1. The housing 11 is made of PE (polyethylene) or hard PVC (Polyvinyl chloride), having thickness 0.8 mm except the neck of 0.3 mm thickness and the size ( length×width×height) 2.6 cm×1.8 cm×0.65 cm. Each brush 1 is made of polyester cotton of 1.5 denier immersed in a shaving lotion (for moistening skin before shaving) for moistening skin before shaving beard or whisker. Then the container 2 is gripped in a hand, and one of the brushes 1 is moved to be located at the outlet 23, with the front portion of the housing 11 removed, with the bristles 10 soaked with the shaving lotion exposed for use. The first one of the brushes 1 is then discarded after use by pushing the next one forward to the outlet 23.

2. The brushes 1 held in a container 2 have been used in coating or painting cosmetic creams, lotions, ointments on any part of a human body, more convenient than cottonbuds. Further, they have been used to clean CD (cassette discs), removing dirt and static electricity. They have been also used to sterilize wounds, with brushes made of polyester strings or cotton of 1.0–2.0 denier soaked with hydrogen peroxide, oxygenated water or iodine, especially convenient for applying ointment to an athlete's foot.

In general, the brushes 1 have high hygienic effect before they are practically used, with the gap between themselves and the housing 11 for a liquid to be stored a little therein for immersing or soaking the bristles 10 so that the liquid may be not carried away by the front portion of the housing 10 when removed off. Further, the container 2 may be utilized as a grip if the brushes 1 are very small, in addition to convenience of carrying.

While the preferred embodiment of the invention has been described above it will be recognized and understood that various modifications may be made therein and the appended claims are intended to cover all such modifications which may fall within the spirit and scope of the invention.

I claim:

1. A combination brush and container assembly for storing the brushes comprising:

said brushes respectively having bristles sealed in a housing, said bristles of each said brush having their roots firmly disposed in a rear portion of said housing, an annular thin neck formed in an intermediate portion of said housing and dividing said housing into a front portion and a rear portion, said neck easily broken to let said front portion of said housing removed from said rear portion so that said bristles may expose out for use;

said container consisting of two half housings to define a hollow interior for storing horizontally a plurality of said brushes one on one, a spring placed on a bottom wall of said interior to elastically push up said brushes, an outlet formed to face forward in an upper end of said two half housings, an opening formed in said upper end communicating with said outlet so that an uppermost one of said brushes stored in said interior may be manually pushed out of or to said outlet;

an uppermost one of said brushes stored in said interior of said container being pushed forward from behind to let said front portion protrude out of said outlet and said neck stop at said outlet and said rear portion still remaining in said opening, said protruding out of said front portion of said housing of said upper-most brush removed off said rear portion of said housing to expose said bristles out for use, and said container functioning as a grip of said brush.

2. The brushes held in a container as claimed in claim 1, wherein said housing of each said brush formed with two opposite corrugated sides of said rear portion where said roots of said bristles are disposed, said corrugated sides clamping firmly said roots of said bristles, and a gap is formed between said roots of said bristles and said inner surfaces of said corrugated sides of said housing.

3. The brushes held in a container as claimed in claim 1, wherein an elastic clamp is respectively provided at two sides of said outlet for clamping two opposite sides of one of said brushes stored in said interior of said container, preventing said brush from falling off said container.

4. The brushes held in a container as claimed in claim 1, wherein said first half housing of said container has a bottom wall larger than that of said second half housing for placing said spring and said brushes orderly thereon, and said second half housing is then conveniently assembled with said first half housing with said brushes and said spring together.

5. A brush comprising:

a) a bristle assembly having a root portion;

b) a housing sealingly surrounding the bristle assembly;

c) the housing including a neck portion dividing the housing into a front portion and a rear portion, the neck portion being recessed inwardly and frangible to permit removal of the front portion from the rear portion and expose the bristles for use; and d) the rear portion including two corrugated sides clamping the root portion of the bristle assembly therebetween, each corrugated side including an inner surface, and a gap formed between the inner surfaces and the root portion of the bristle assembly.

6. A container for storing a plurality of articles, the container comprising:

a) a first housing half and a second housing half, the housing halves collectively defining an interior space therebetween and including a bottom wall, an upper end, an outlet formed in the upper end for dispensing articles stored in the interior space, and an opening formed in the upper end for permitting the articles to be manually dispensed through the outlet;

b) a spring disposed within the interior space and on the bottom wall for elastically urging the articles stored within the interior space toward the upper end; and c) the outlet includes two sides, an elastic clamp disposed at each side for clamping each uppermost article and preventing the uppermost article from falling out of the container.

7. A container for storing a plurality of articles, the container comprising:

a) a first housing half and a second housing half, the housing halves collectively defining an interior space therebetween and including a bottom wall, an upper end, an outlet formed in the upper end for dispensing articles stored in the interior space, and an opening formed in the upper end for permitting the articles to be manually dispensed through the outlet;

b) a spring disposed within the interior space and on the bottom wall for elastically urging the articles stored within the interior space toward the upper end; and c) the bottom wall being defined by a first bottom wall portion of the first housing half and a second bottom wall portion of the second housing half, the first bottom wall portion being larger than the second bottom wall portion for permitting the articles and the spring to be positioned on the first bottom wall portion during assembly of the container.

* * * * *